United States Patent [19]

DeMarco

[11] Patent Number: 4,638,827

[45] Date of Patent: Jan. 27, 1987

[54] FOLDING UMBRELLA

[76] Inventor: Joseph DeMarco, 60 Seaman Ave., New York, N.Y. 10034

[21] Appl. No.: 742,316

[22] Filed: Jun. 7, 1985

[51] Int. Cl.[4] ..... A45B 19/06; A45B 11/00

[52] U.S. Cl. ..... 135/26; 135/29; 135/20 M

[58] Field of Search ..... 135/20 R, 20 M, 25 R, 135/25 A, 25, 26, 16, 99, 75, DIG. 8

[56] References Cited

U.S. PATENT DOCUMENTS

| | | | |
|---|---|---|---|
| 1,233,718 | 7/1917 | Shirley | 135/75 |
| 1,240,001 | 9/1917 | Youngren | 135/75 X |
| 1,839,309 | 1/1932 | Gundel | 135/75 X |
| 2,088,127 | 7/1937 | Zeitschler | 135/26 |
| 2,187,372 | 1/1940 | Capaldo | 135/75 X |
| 3,693,643 | 9/1972 | Weber | 135/26 |
| 3,732,879 | 5/1973 | Okuda | 135/20 R |
| 3,818,919 | 6/1974 | Schultes et al. | 135/20 R |
| 4,350,175 | 9/1982 | DeMarco | 135/33 C |

*Primary Examiner*—Robert A. Hafer
*Assistant Examiner*—D. Neal Muir
*Attorney, Agent, or Firm*—Bauer & Amer

[57] ABSTRACT

A folding umbrella, particularly useful as a beach umbrella, in which circumferentially spaced outer ribs are slidably disposed on cooperating struts as the undersupport of the fabric cover, and in one extreme position of the slides, the umbrella opens to a radius of approximately 42 inches, and in an opposite slide position, the umbrella closes to a radius of approximately 32 inches, the 10 inch difference being the result of slide movement of the end of the rib along a strut which produces an internal fold in a central location of the fabric cover and thus diminishes its size accordingly.

2 Claims, 5 Drawing Figures

FOLDING UMBRELLA

The present invention relates to folding umbrellas and in particular to the construction of a large diameter folding sun umbrella.

BACKGROUND OF THE INVENTION

1. Field of the Invention

Umbrellas, intending to shade the sun such as beach umbrellas, picnic umbrellas and the like require a large radius to be effective. Consequently, conventional folding sun umbrellas have been overly large and have as a result a complex rib and bracing structure as is required to maintain the relatively heavy canvas or plastic fabric cover in taut extended position.

2. Description of the Related Art

Conventionally folding umbrellas comprise a fabric cover disposed over a plurality of ribs hinged at one end to a central rod extending spoke-like outwardly from the rod. Each rib is extended and held in open condition by an articulating triangular bracing arrangement comprising a strut secured at one end to a slide riding on the rod and hinged at its other end to the rib, medial of its ends. It should be thus apparent that the length of the rib is in direct proportion to the radius of the umbrella and consequently a large diameter sun umbrella requires long ribs.

As the ribs are increased in length, they must be made of stronger and of heavier material so as to be able to carry the correspondingly enlarged fabric cover. As a result, the ribs must be provided with a stronger and more complex bracing system, including additional struts and additional articulation points.

In my earlier U.S. Pat. Nos. 4,007,753 and 4,350,175 sectional, fold-over ribs were employed as are used in standard umbrellas. I have found that such ribs are not useful when large diameter umbrellas are required.

It is the object of the present invention to provide a folding umbrella, of large diameter, which overcomes the disadvantages and inconveniences of the prior art.

It is a further object to provide a sun umbrella of the folding type which is light in weight and simpler in construction than those heretofore known.

It is a further object of the present invention to provide an umbrella construction having an improved and simplified rib and bracing arrangement.

These objects as well as others together with the numerous advantages will be apparent from the following disclosure of the invention.

SUMMARY OF THE INVENTION

The improved folding umbrella of the present invention is developed from the concept that the length of the rib supporting the fabric cover does not need to be as long as the diameter of the open umbrella nor does it need to be hinged directly to the central rod. According to the present invention, such a smaller free-floating rib can be used, by providing a bracing or strut arrangement which in combination with the rib and the fabric cover holds the ribs stably and rigidly in extended position and which simultaneously permits folding of the rib into parallel contact with the central rod.

Thus, the ribs do not have to be made of heavy material, or have any particularly strong configuration; nor does the strut arrangement have to be complicated or complex in articulation; nor does the full weight of the cover have to be borne by the extending ribs alone. The umbrella of the present invention is thus simpler, cheaper, lighter in weight and easier to use than those heretofore known.

In particular, the umbrella of the present invention comprises a folding umbrella comprising a central rod, a plurality of circumferentially spaced ribs, each of a length less than the intended diameter of the umbrella, a fabric cover disposed over said ribs, and an articulating strut arrangement for extending said ribs outwardly with respect to said rod to deploy said cover and for folding said ribs and cover toward said rod, said strut arrangement comprising a set of upper struts and a set of lower struts, each set having a number corresponding to the number of said ribs and arranged in associated pairs, in the same vertical plane, the upper strut of each pair being hinged at one end to the upper end of said rod and at its other end to the lower strut medial of its ends, the lower strut in each pair being hinged at one end to a rib member having a slide member disposed about said upper strut for movement up and down therealong, the downward movement of said slide causing said lower and upper struts to extend outwardly from the rod forming therewith a triangle, and the upward movement of said slide causing said lower and upper struts to fold against said rod parallel therewith.

The rib associated with pair of struts being hinged medial of its length to the outer end of said lower strut and being hinged at its inner end to a sleeve disposed about the upper strut for movement up and down said upper strut, said cover being attached at its outer periphery to the outer ends of said ribs and at its inner periphery to said rod, said upper strut passing through said cover at the inner end of said rib to maintain said cover taut between the inner and outer ends of said rib while permitting said sleeve to slide along said outer strut.

Preferably, the cover is provided with means such as a grommet, through which the upper strut passes. The grommet being of such material that it is sufficiently strong to maintain the cover tightly and tautly stretched between the strut and the outer tip so that the rib is constantly under tension. This tension acts to hold the rib at the end of the strut arrangement in the correct disposition when opened and/or closed. Grommets of metal such as aluminum, or nylon or similar plastic are of such strength and also of low friction to allow sliding of the grommet against the strut.

BRIEF DESCRIPTION OF THE DRAWING

Full details of the present invention are set forth in the following description and illustrated in the accompanying drawings.

DESCRIPTION OF THE PREFERRED EMBODIMENT

Figure 3:
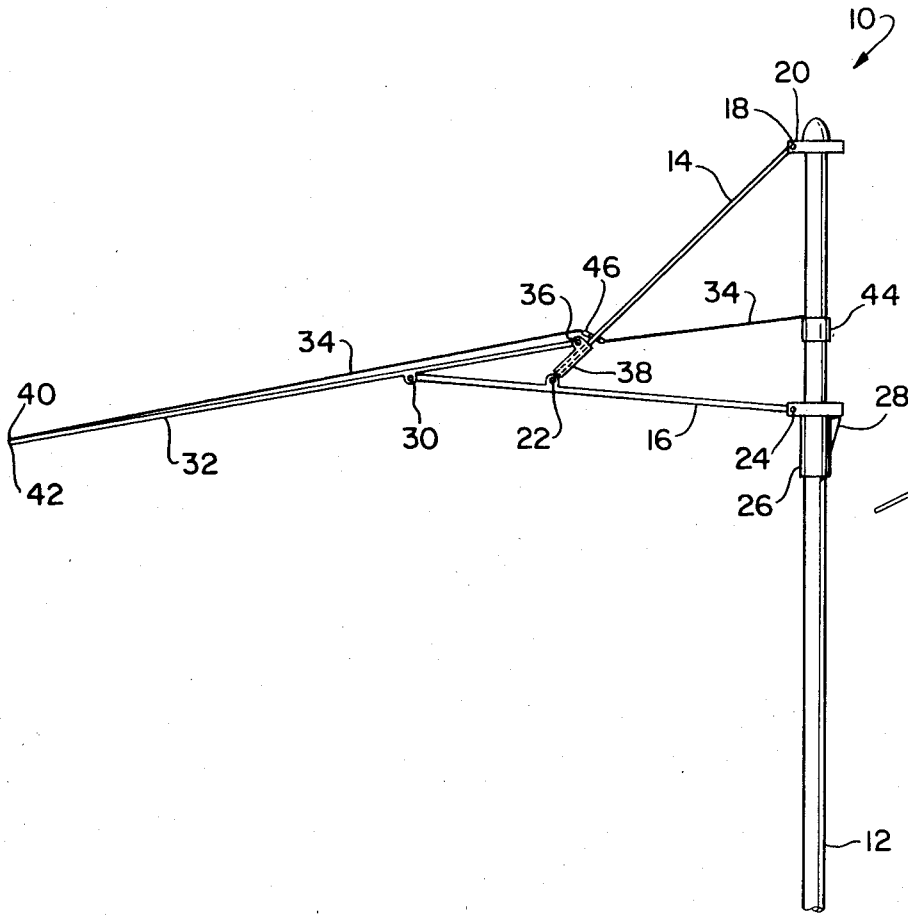
FIG. 3 is a radial section of the umbrella of FIG. 1 showing the ribs and bracing arrangement fully deployed.

Referring to the drawings and particularly FIG. 3, the umbrella, generally designated 10, is formed with a central rod 12 about which is circumferentially disposed and spaced from each other, a set of upper struts individually and collectively designated 14 and a correspondingly arranged set of lower struts individually and collectively designated 16. The upper end of the upper struts 14 are hinged at 18 to a hub 20 fixed at the top end of the rod. The lower end of the upper strut 14 is hinged at 22 to the lower strut 16. The inner end of the lower strut 16 is hinged at 24 to a radial flange of a slide 26 adapted to move up and down along the rod 12. A depressible latch 28 of conventional construction, is located in the rod and is adapted to engage below the flange of the slide, thus holding the slide in its uppermost position, while depression of the latch allows the slide to move downwardly.

It will be observed that the struts form a collapsible triangular articulation, wherein when the umbrella is opened the lower strut extends substantially perpendicularly from the central rod and the upper strut at an acute angle from the rod, and in the collapsed position, both the upper and lower struts extend substantially coaxially parallel to the axis of the rod.

The lower strut extends beyond the pivot point with the upper strut and 15 itself connected at the outer end by pivot 30, to a rib 32, on which the umbrella fabric 34 rests. The pivot 30 connecting the lower strut 16 to the rib 32 is inwardly of the inner end of the rib 32, which is itself connected by a pivot 36 to a slide or sleeve 38, which rides over the upper struts 14.

The fabric 34 of conventional material and form covers all of the ribs 32 and is fixed at its outer perimeter 40 to the ends of each of the ribs 32 by conventional retaining tips 42, and at its center is fixed by being wedged between the central rod 12 and collar 42 fastened to the rod 12. At the point where the fabric would reach the pivot 36 on slide 38, it is provided with an eyelet or grommet 46 through which the upper strut 14 passes being inserted therethrough before it is attached to the central rod 12.

Figure 1:
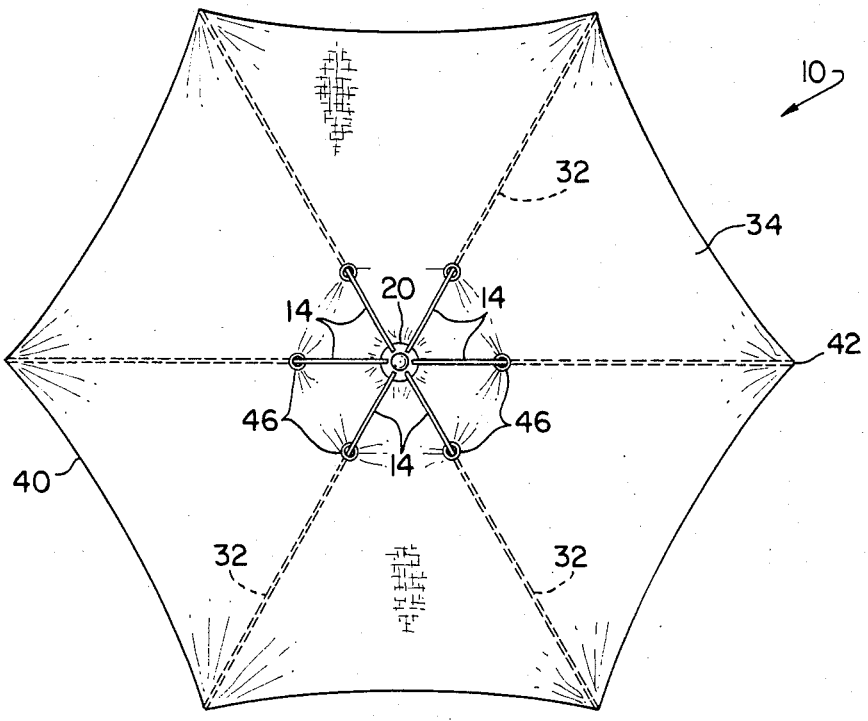
FIG. 1 is a top plan view of the umbrella, embodying the present invention, fully deployed.
Figure 2:
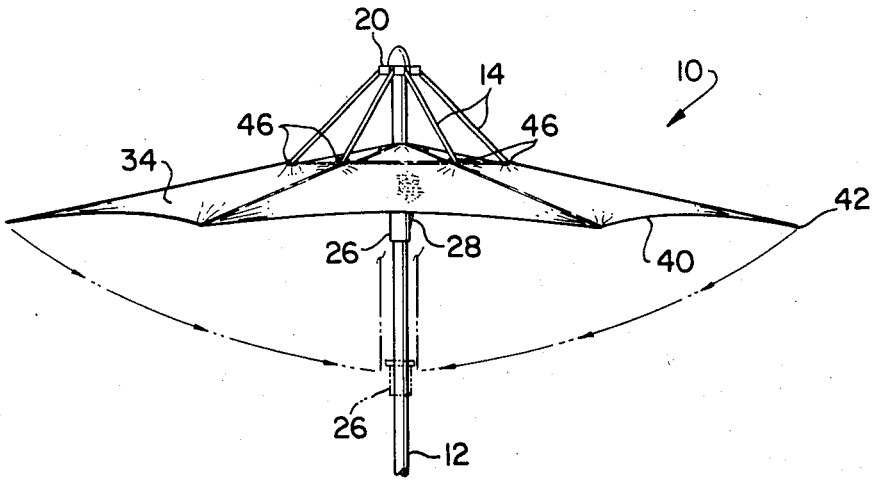
FIG. 2 is a side elevational view of the umbrella, shown in FIG. 1, with the direction of folding shown in phantom.
Figure 5:
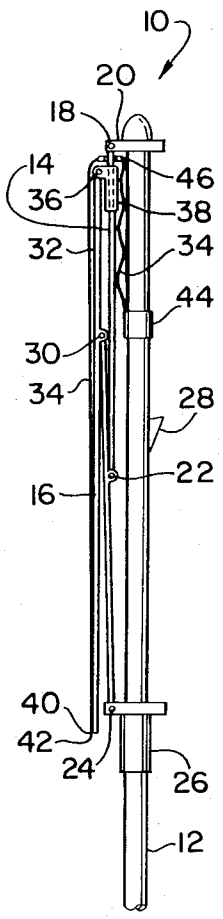
FIG. 5 is a view showing the ribs and bracing arrangement fully collapsed.
Figure 4:
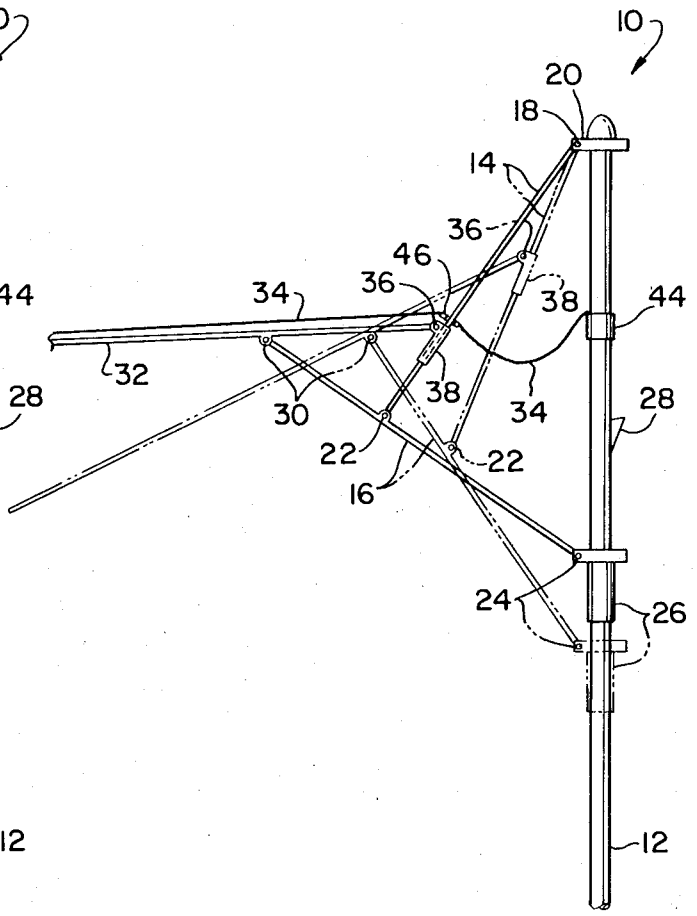
FIG. 4 is a view similar to FIG. 3 showing successive intermediate positions (full lines and phantom lines respectively) of the ribs and bracing arrangement in the act of being collapsed.

The outer perimeter of the fabric 34 is cut and sewn to provide sufficient radial tension between the tip 42 and the grommet 46, so that the grommet normally engages the upper strut 14 just above the sleeve 38. In this manner, the outer band of fabric, i.e., between the grommets 46 and the tips 42, is always in stretched and taut condition. The inner band of fabric, i.e., between the grommets 46 and the collar 44, has a dimension sufficient so that it is stretched only when the umbrella is open (FIG. 3) and hangs loose when the umbrella is closed (FIGS. 4 and 5).

It will also be observed that the ribs make with upper and lower struts a second collapsible triangle which in the open condition of the umbrella is relatively small, having its position defined by the abutment of the sleeve 38 against the lower strut. As the umbrella is closed the sleeve 38 rides up along the upper struts 14 enlarging the second triangle as seen in both the solid and dotted line positions of FIG. 4 until a point wherein the ribs 42 fold back on the struts 14 and 16. As the struts 14 and 16 take their axial position as shown in FIG. 5, the rib 42 also assumes a parallel position relative to the rod 12. The outer band of the fabric remains tensioned along the length of the rib while the inner band folds inwardly and is hidden within the folded umbrella next to the rod 12.

The effective height of the umbrella is defined by the rib 42 but the effective diameter of the umbrella is defined by the length of the rib 42 and distance of the inner band of the fabric which is defined substantially by the perpendicular distance between the pivot point 36 and slide or sleeve 38.

In a preferred embodiment, the radius of the umbrella when open is approximately 42 inches, consisting of the radial extent of each rib and the length of the cover between the eyelet and the slide 26, and when the umbrella is closed, said radius is of the reduced dimension of approximately 32 inches, which is the size only of the ribs. The difference of 10 inches is taken up in the internal fold created in the central location of the cover.

Because the 42 inch beach umbrella hereof is only 32 inches when closed, it has been found in practice that there is no need for a crank in order to have the necessary mechanical advantage that a crank provides to open and close the umbrella.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A folding umbrella comprising a central rod having an upper and a lower end, a plurality of circumferentially spaced ribs each having a slide at one end and each of a length less than the intended radius of the umbrella, a fabric cover of a size coextensive with the intended radius of the umbrella disposed over said ribs, and an articulating strut arrangement for extending said ribs outwardly with respect to said rod to deploy said cover and for folding said ribs and cover toward said rod, said strut arrangement comprising a set of upper struts and a set of lower struts, each set having a number corresponding to the number of said ribs and arranged in associated triads, the upper strut of each triad being hinged at one end to the upper end of said rod and at its other end to a correspondingly lower strut medial of the ends of said lower strut, the lower strut in each pair being hinged at one end to a corresponding rib which has said slide thereon disposed about a corresponding upper strut for movement up and down therealong and being connected at its other end to a slide runner disposed for sliding movement up and down along said rod, the downward movement of said slide runner causing said lower and upper struts to extend outwardly from the rod forming therewith a triangle and opening said cover thereon to the fullest size thereof corresponding to the intended radius of the umbrella, and the downward movement of said slide runner causing said lower and upper struts to fold against said rod substantially parallel therewith simultaneously with causing a folding in said cover above said slides of said ribs whereby said cover in said closed umbrella is of a reduced radial extent equal to that of said ribs.

2. A folding umbrella as claimed in claim 1, wherein said cover has plural eyelets located above said slides and has its outer periphery connected to the ends of said ribs and at a central location is connected to said rod, whereby said cover folds during the closing of said umbrella in the area thereof between said eyelets and said connection to said rod.

* * * * *